US011234501B2

(12) United States Patent
Chenier

(10) Patent No.: US 11,234,501 B2
(45) Date of Patent: Feb. 1, 2022

(54) PROTECTIVE CASE FOR ELECTRONIC DEVICES

(71) Applicant: Andre Lamont Chenier, Tomball, TX (US)

(72) Inventor: Andre Lamont Chenier, Tomball, TX (US)

( * ) Notice: Subject to any disclaimer, the term of this patent is extended or adjusted under 35 U.S.C. 154(b) by 0 days.

(21) Appl. No.: 16/900,418

(22) Filed: Jun. 12, 2020

(65) Prior Publication Data

US 2020/0405027 A1 Dec. 31, 2020

Related U.S. Application Data

(60) Provisional application No. 62/867,726, filed on Jun. 27, 2019.

(51) Int. Cl.
*A45C 11/00* (2006.01)

(52) U.S. Cl.
CPC ..... *A45C 11/00* (2013.01); *A45C 2011/002* (2013.01)

(58) Field of Classification Search
CPC .... A45C 11/00; A45C 2011/003; A45C 11/01
See application file for complete search history.

(56) References Cited

U.S. PATENT DOCUMENTS

2016/0094263 A1* 3/2016 Fathollahi ..... H04B 1/3888 455/575.8
2016/0164565 A1* 6/2016 Witter ..... A45C 11/00 455/575.8
2016/0198824 A1* 7/2016 Rayner ..... H04M 1/185 224/191
2020/0098498 A1* 3/2020 Mora ..... A45C 11/00

* cited by examiner

*Primary Examiner* — Qutbuddin Ghulamali
(74) *Attorney, Agent, or Firm* — Ferguson Braswell Fraser Kubasta PC; John T. Mockler

(57) ABSTRACT

A protective case for an electronic device. The protective case comprises a shell configured to receive the electronic device. The shell includes: i) sidewalls that encircle the periphery of the electronic device; ii) an inner wall proximate the rear surface of the electronic device; and iii) an outer wall configured to form with the inner wall a compartment adjacent the rear surface of the device. Each of the sidewalls comprises a convex shape that curls around an edge of the device. The inner wall comprises a grid of raised bumps that provide cushioning between the rear surface of the electronic device and the inner wall. The outer wall forms a plurality of slots, each of the slots configured to receive an adaptor module that connects the protective case to a peripheral device or a support structure.

10 Claims, 14 Drawing Sheets

PROTECTIVE CASE FOR ELECTRONIC DEVICES

CROSS-REFERENCE TO RELATED APPLICATION(S) AND CLAIM OF PRIORITY

The present application is related to U.S. Provisional Patent No. 62/867,726, filed 27 Jun. 2019, entitled "Case for Mobile Phones and Other Electronics". Provisional Patent No. 62/867,726 is assigned to the assignee of the present application and is hereby incorporated by reference into the present application as if fully set forth herein. The present application hereby claims priority under 35 U.S.C. § 119(e) to U.S. Provisional Patent No. 62/867,726.

TECHNICAL FIELD

The present application relates generally to protective cases for electronic devices and, more specifically, to a protective case for mobile phones and tablets.

BACKGROUND

A large market exists for protective cases that protect mobile phones and tablets. The protective cases range from simple form-fitting rubber sheaths that protect the edges of the mobile device to more complex devices that ensconce the entire mobile device in a rigid case with a transparent protective glass front panel.

However, a common problem with conventional protective cases is that they prevent the mobile device from being used with third party accessories, such as external batteries, lights, tripod stands, mounting fixtures, and other peripherals. Protective cases typically provide openings to allow power cords and headphone wires to be plugged into the mobile device ports, but other custom accessories that might, for example, clamp onto the edges of the mobile device may be interfered with by the protective case. The result is that the protective case often must be removed so that the mobile phone can be used with other peripheral devices.

There is a need for a protective case that provides flexibility and enhanced capabilities for integrating the mobile device with peripheral devices. In particular, there is a need for a protective case that can be adapted to a wide variety of peripheral devices so that it is rarely necessary to remove the protective case from the mobile device.

SUMMARY

To address the above-discussed deficiencies of the prior art, it is a primary object to provide a protective case for an electronic device. The electronic device comprises a shell configured to receive the electronic device. The shell includes: i) a plurality of sidewalls that encircle the periphery of the electronic device; ii) an inner wall that is proximate the rear surface of the electronic device; and iii) an outer wall configured to form with the inner wall a compartment adjacent the rear surface of the electronic device.

In one embodiment, each of the plurality of sidewalls comprises a convex shape that curls around an edge of the electronic device.

In another embodiment, the inner wall comprises a grid of raised bumps that provide cushioning between the rear surface of the electronic device and the inner wall.

In still another embodiment, the outer wall forms a plurality of slots, each of the plurality of slots configured to receive an adaptor module that is used to connect the protective case to a peripheral device or a support structure.

In yet another embodiment, a first of the plurality of slots comprises a securing mechanism configured to retain an adaptor module in the first slot.

In a further embodiment, the securing mechanism comprises at least one magnet positioned in the first slot to align with a corresponding magnet on the adaptor module when the adaptor module is inserted in the first slot.

In a still further embodiment, the securing mechanism comprises a catch positioned in the first slot to align with a latching mechanism on the adaptor module when the adaptor module is inserted in the first slot.

In a yet further embodiment, the outer wall comprises a flat central portion that is substantially parallel to the inner wall and a plurality of sloped surfaces surrounding the flat central portion.

In an embodiment, the compartment formed by the outer wall and the inner wall has a horizontal cross-section that is substantially trapezoidal.

In another embodiment, the compartment formed by the outer wall and the inner wall has a vertical cross-section that is substantially trapezoidal.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 14, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged protective case for a mobile device.

The principles of the present disclosure may be adapted to a wide variety of mobile devices, including mobile phone, tablets, and very small computers. However, for simplicity of explanation, the descriptions that follow and the related drawings are directed to a protective case that is adapted for use with an iPhone, such as an iPhone X. However, this should not be construed to limit the scope of the present disclosure or the claims herein. The disclosed protective case may readily be adapted for use with other models of mobile phones, tablets, and similar handheld electronic devices.

The disclosed protective case comprises a rear compartment formed by an inner wall that contacts the back surface of the phone and an outer wall. The inner and outer walls form a cavity or rear compartment on the back of the phone. The rear compartment provides mating structures that enable allow diverse accessories and peripherals to be attached to the protective case with a high degree of modularity, easy accessibility, and functionality. The rear compartment includes multiple attachment points and multiple connection options. Unlike conventional, single accessory, protective cases, the disclosed protective case allows multiple accessories to be attached to the mobile device at the same time.

The attachable accessories may include lights, wallets, straps, batteries, wall mounts, additional cases, and the like. The protective case supports broad use within many different areas of industry, such as medicine, retail, hospitality, food and beverage, law enforcement, the military, and the like. The mounting or attachment features of the protective case are also useful for other products, such as radio handsets, medical instruments, barcode scanners, firearms, ammunition, computer peripherals, and the like. The protective case makes the mobile device more functional, easier to handle, and more versatile and protects the mobile device from damage due to falls, mishandling, or dropping.

Figure 1:
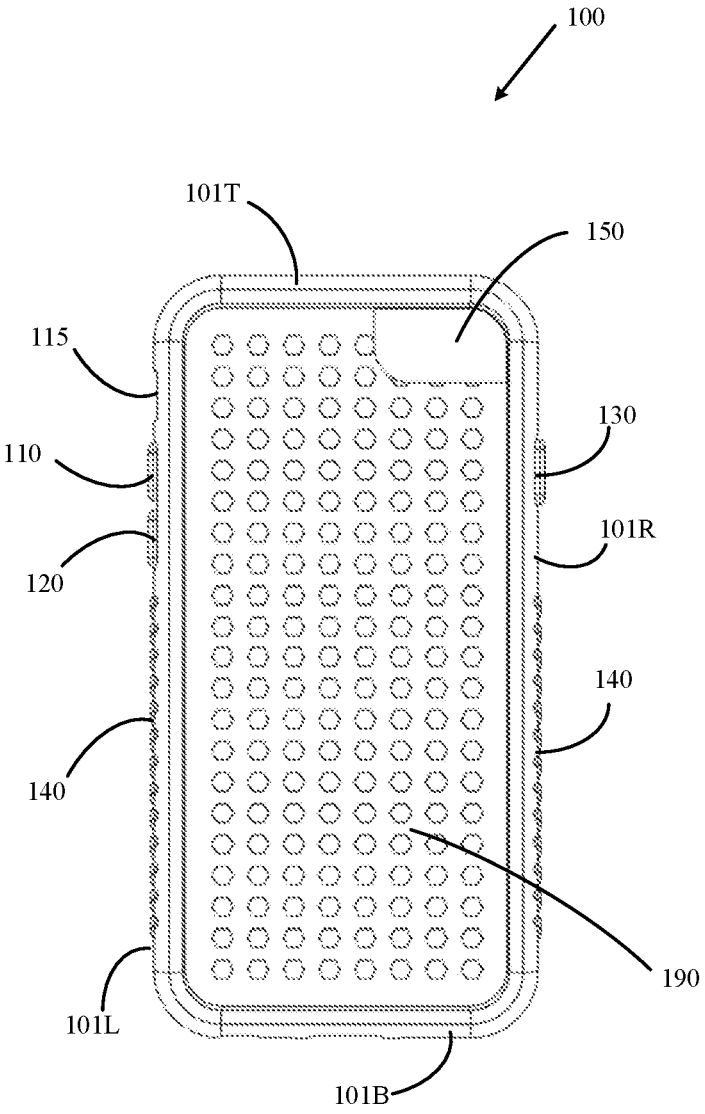
FIG. 1 is a view of the front of a protective case according to one embodiment of the disclosure.
Figure 2:
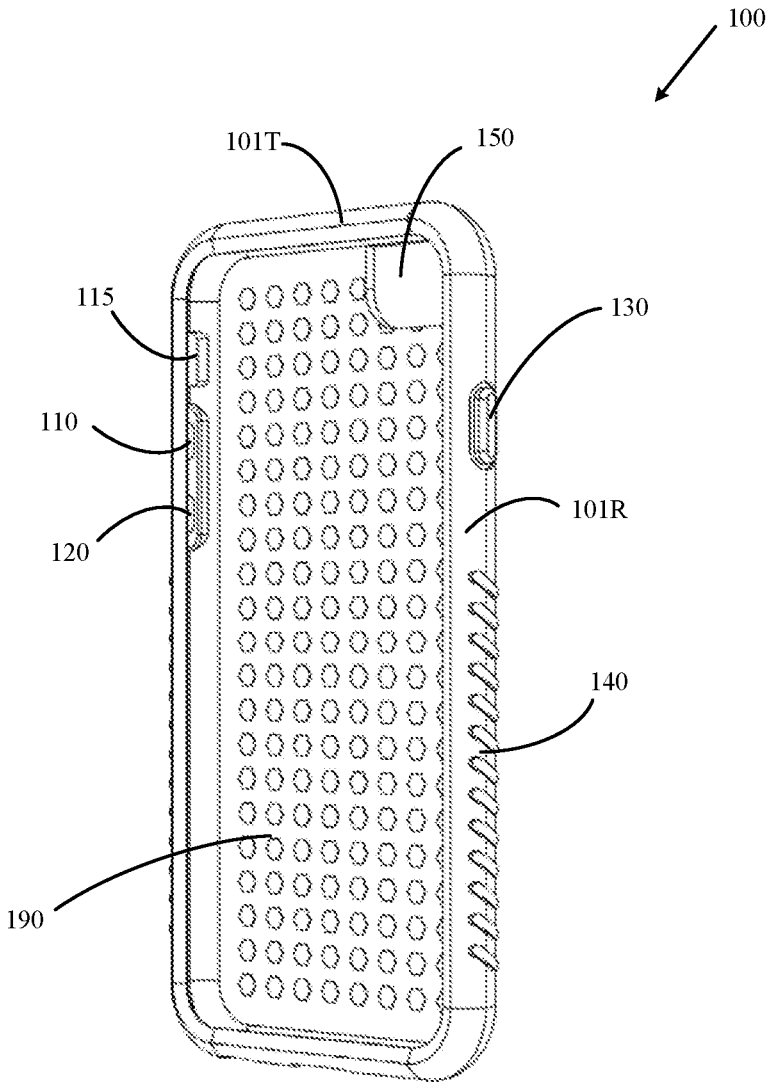
FIG. 2 is a side perspective view of a protective case according to one embodiment of the disclosure.

FIG. 1 is a view of the front of protective case 100 according to one embodiment of the disclosure. FIG. 2 is a side perspective view of protective case 100 according to one embodiment of the disclosure. In FIGS. 1 and 2, there is no mobile phone in protective case 100. Protective case 100 comprises a shell that includes the four sidewalls 100, including top sidewall 101T, bottom sidewall 101B, left sidewall 101L, and right sidewall 101R, that surround the periphery of the mobile phone. The shell of the protective case 100 also comprises inner wall 190. Typically, the four sidewalls 101 are concave walls that curve around the side edges of the mobile phone that is disposed inside of protective case 100 and hold the mobile phone in place. Protective case 100 is conventionally made from a rigid rubber or plastic material that is flexible enough to curl around the edges of the mobile phone, but stiff enough to hold the phone in place even if violently shaken. In the exemplary embodiment, the inner surface of inner wall 190 is covered by a grid of circular bumps that provide additional cushioning between the back surface of a mobile phone and the inner surface of inner wall 190.

Camera opening 150 is formed in inner wall 190 to allow the camera on the back of the mobile device to function. Opening 115 in left sidewall 101L allows an operator to control the ring/silent switch on an iPhone. Volume buttons 110 and 120 are essentially raised ridges on left sidewall 101L that align with the Up and Down volume buttons on an iPhone. Pressing the Volume buttons 110 and 120 presses the raised ridges into the Up and Down volume buttons, thereby adjusting the volume. Similarly, side button 130 is a raised ridge on right sidewall 101R that aligns with the Side button on the iPhone. Pressing the Side button 130 presses the raised ridge into the Side button on the iPhone, thereby turning the screen on and off, for example. Additionally, each of the outer surfaces of left sidewall 101L and right sidewall 101R comprises a plurality of grip ridges 140 that prevent the protective case 100 from slipping from the grip of the person using the mobile phone.

Figure 3:
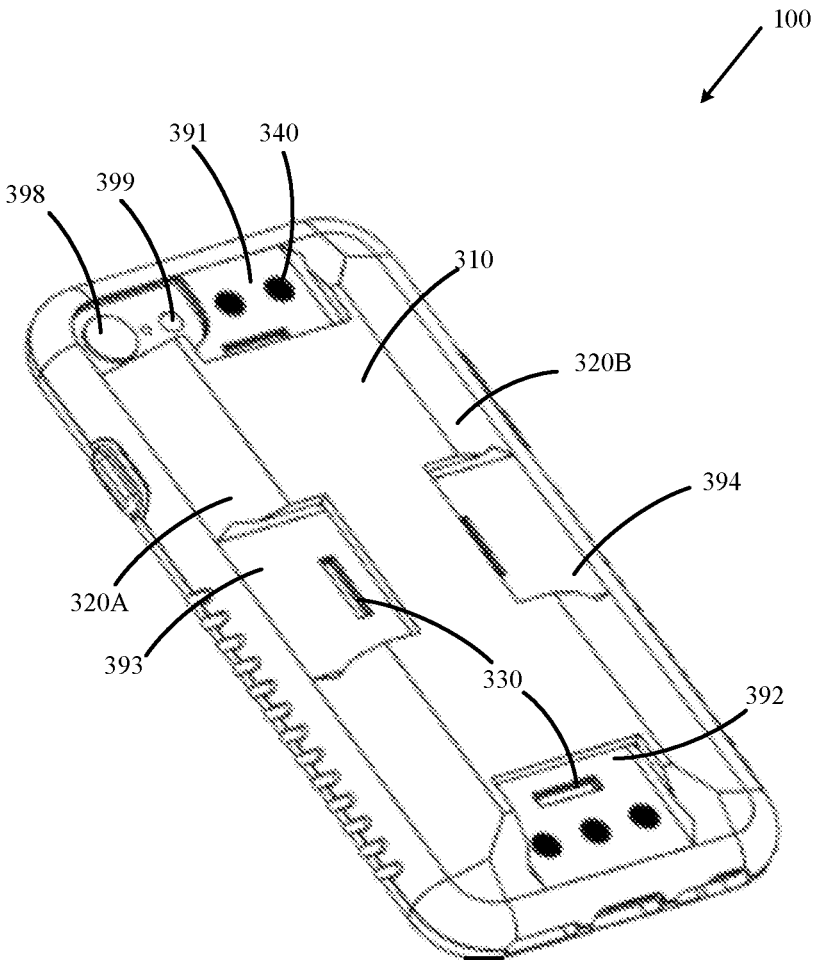
FIG. 3 is a perspective view of the back of a protective case according to one embodiment of the disclosure.
Figure 4:
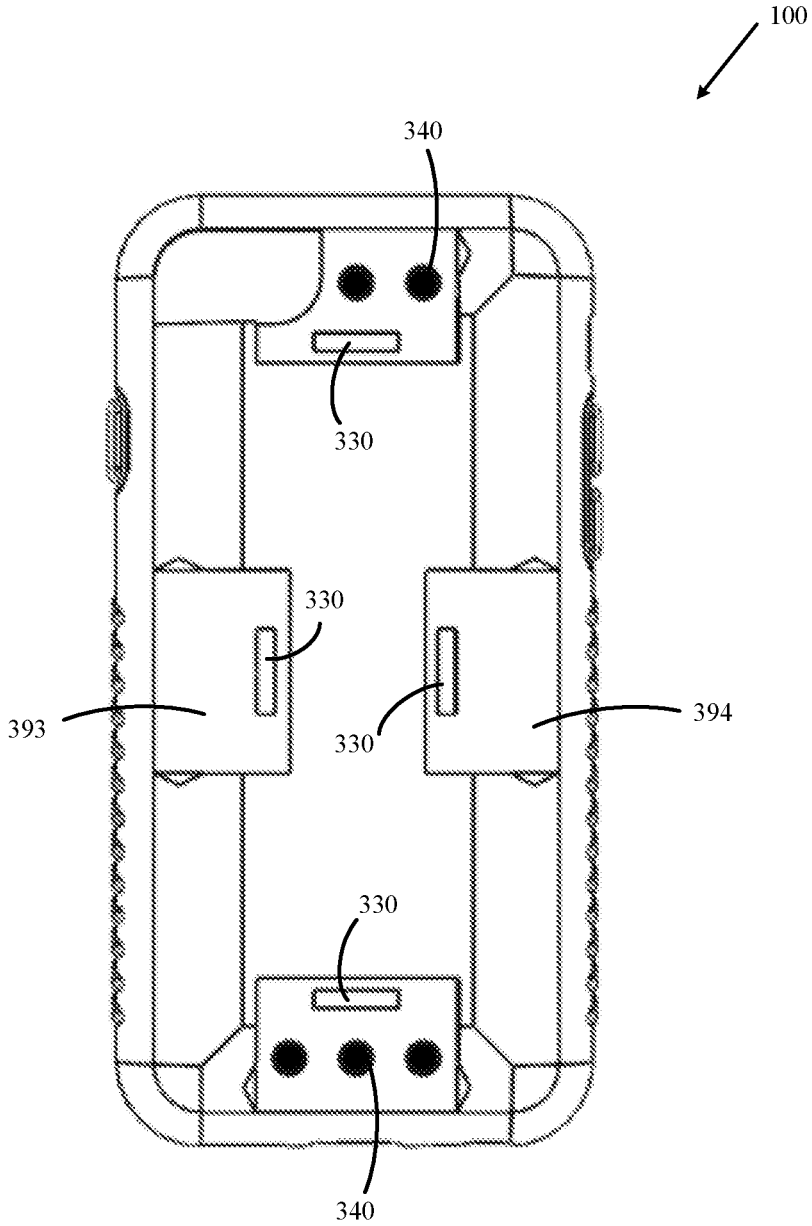
FIG. 4 is a view of the back of a protective case according to one embodiment of the disclosure.

FIG. 3 is a perspective view of the back of protective case 100 according to one embodiment of the disclosure. FIG. 4 is a view of the back of protective case 100 according to one embodiment of the disclosure. In FIG. 3, a mobile phone is present in protective case 100, such that camera lens 398 and flash 399 are visible in camera opening 150.

The back of protective case 100 comprises outer wall 310, which includes a flat central portion and a plurality of sloping surfaces 320A and 320B on the left side and right side of outer wall 310, respectively. The flat central portion is substantially parallel to the inner wall 190. The top and bottom regions of outer wall 310 also have smaller (and unlabeled) sloping surfaces that are adjacent to the flat central portion. As noted above, outer wall 310 and inner wall 190 form a compartment or cavity on the back of protective case 100. The sloping surfaces taper inward toward the outer edges of the outer wall. Due to the sloping surfaces, the horizontal and vertical cross-sections of the compartment comprise substantially trapezoidal shapes.

Each sloping surface of outer wall 310 comprises a slot that accesses the compartment. For example, slot 391 is formed in the sloping surface at the top of outer wall 310, slot 392 is formed in the sloping surface at the bottom of outer wall 310, slot 393 is formed in sloping surface 320A, and slot 394 is formed in sloping surface 320B. Each of slots 391-394 includes one of rectangular catches 330. Additionally, one or more of slots 391-394 may include one or more magnets 340. As explained below in further detail, catches 330 and magnets 340 are used to secure plugs, adaptor modules and peripheral devices that may be inserted into slots 391-394.

The sloping surfaces on outer wall 310 on the back of protective case 100 means that protective case 100 tapers more narrowly towards the edges. This contoured shape provides a more secure grip and other protections. A user often puts a phone on a surface with the screen facing up. In this common scenario, the phone will be easier to pick up because the shape of outer wall 310 elevates the phone off the surface and the user's fingers can curl under the phone for better gripping surface area and leverage. Thus, a user is less likely to drop the phone because of a lack of a firm grip when picking up and setting down the phone.

Figure 5A:
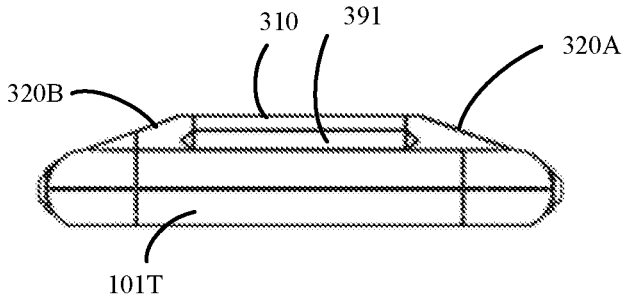
FIG. 5A is a view of the top of a protective case according to one embodiment of the disclosure.
Figure 5B:
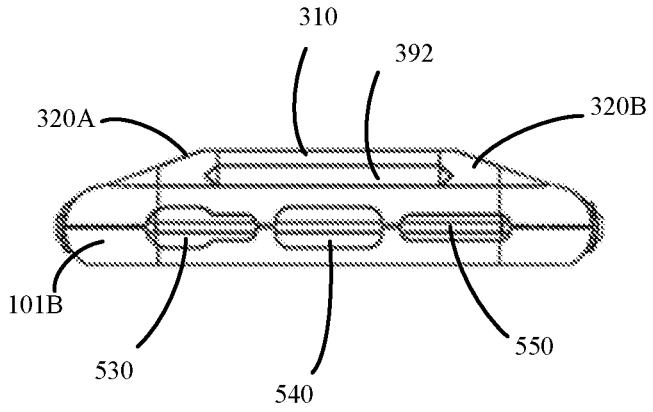
FIG. 5B is a view of the bottom of a protective case according to one embodiment of the disclosure.
Figure 6A:
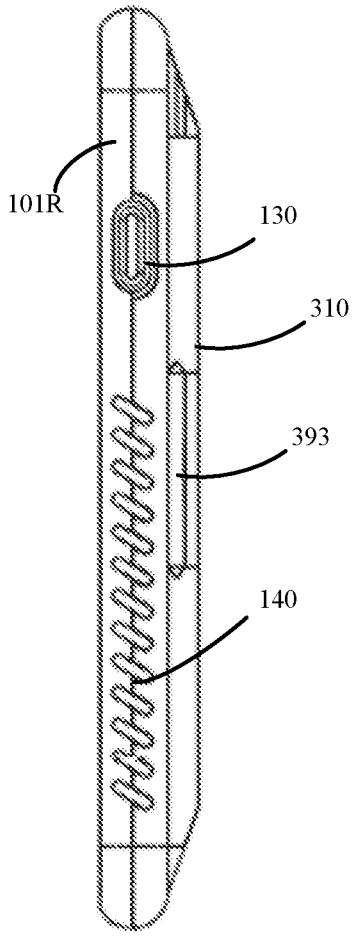
FIG. 6A is a view of the right side of a protective case according to one embodiment of the disclosure.
Figure 6B:
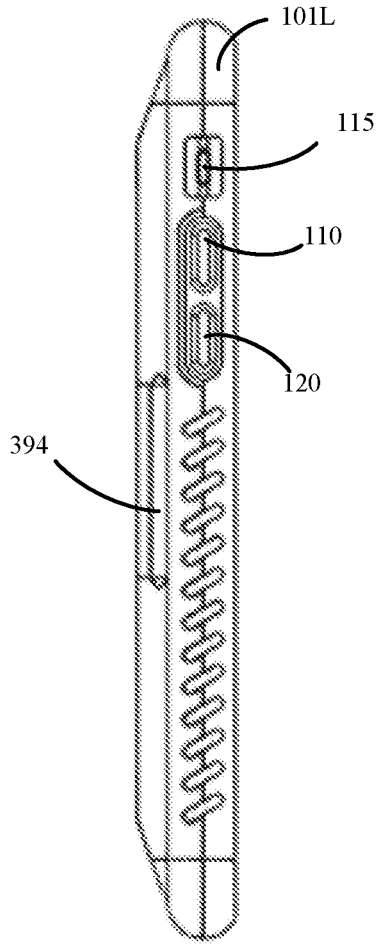
FIG. 6B is a view of the left side of a protective case according to one embodiment of the disclosure.

FIG. 5A is a view of the top of protective case 100 according to one embodiment of the disclosure. FIG. 5B is a view of the bottom of protective case 100 according to one embodiment of the disclosure. FIG. 6A is a view of the right side of a protective case according to one embodiment of the disclosure. FIG. 6B is a view of the left side of a protective case according to one embodiment of the disclosure. Bottom sidewall 101B of protective case 100 comprises openings 530, 540 and 550. Opening 530 aligns with the microphone of the iPhone. Opening 540 aligns with the power cord port of the iPhone. Opening 550 aligns with the speaker of the iPhone.

Slots 391-394 are visible in FIGS. 5A, 5B, 6A, and 6C. Slots 391-394 are female receive paths that have beveled edges that mate with beveled edges of adapter modules that are inserted into slots 391-394. The adapter modules permit the protective case to be attached to peripheral devices, tripod stands, straps, and the like. Advantageously, slots 391-394 provide access to a cavity or compartment that is formed inside protective case 100 by inner wall 190 and outer wall 310. Slots 391-394 permit storage of small objects like keys, remote controls sensors, or any number of functional objects that fit inside the interior space.

Figure 7:
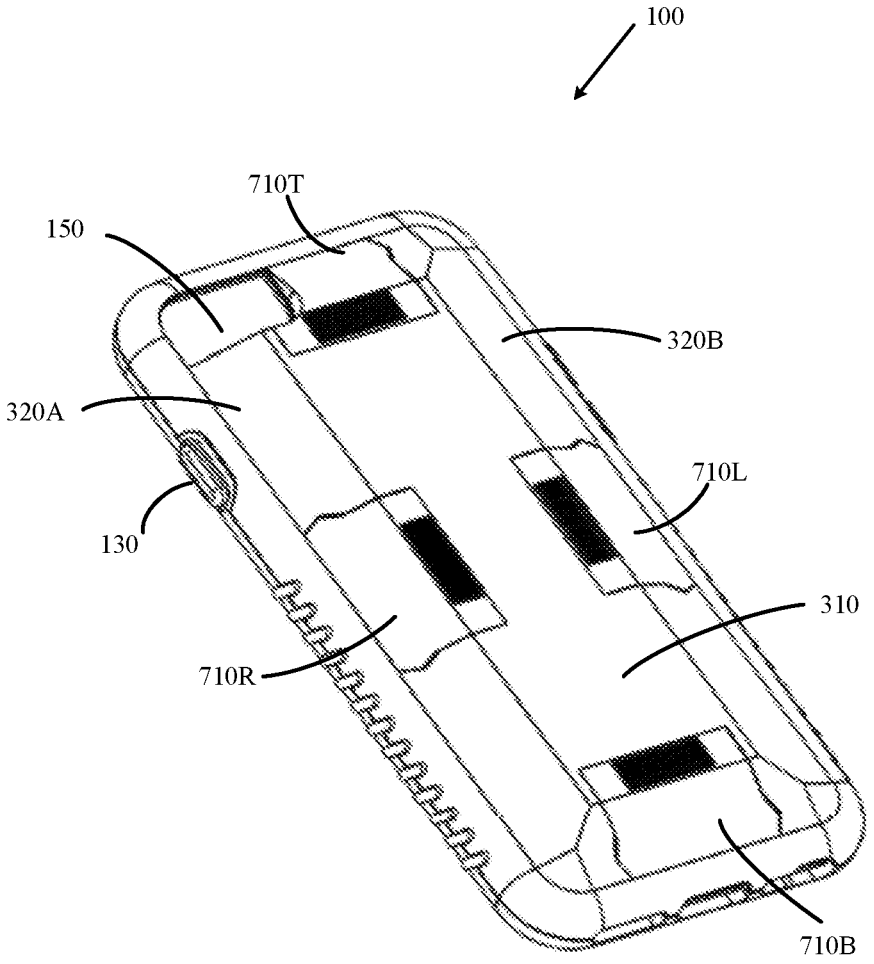
FIG. 7 is a perspective view of the back of a protective case with inserted custom plugs according to one embodiment of the disclosure.
Figure 8A:
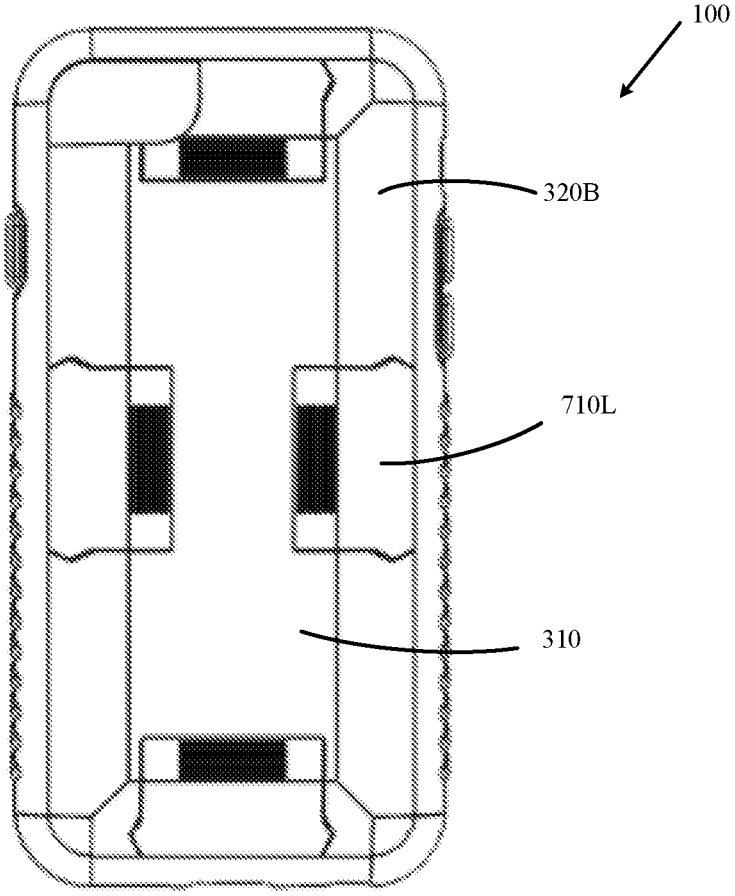
FIG. 8A is a view of the back of a protective case with inserted custom plugs according to one embodiment of the disclosure.
Figure 8B:
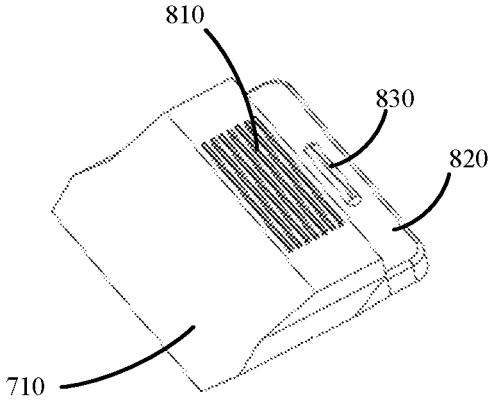
FIG. 8B is a view of a plug for a protective case according to one embodiment of the disclosure.

Furthermore, custom plugs may be inserted into slots 391-394 to seal off the internal compartment when it is not in use. FIG. 7 is a perspective view of the back of protective case 100 with inserted custom plugs 710 according to one embodiment of the disclosure. FIG. 8A is a view of the back of a protective case 100 with inserted custom plugs 710 according to one embodiment of the disclosure. FIG. 8B is a detailed perspective view of plug 710 for protective case 100 according to one embodiment of the disclosure.

Top plug 710T is inserted into slot 391, bottom plug 710B is inserted into slot 392, right plug 710R is inserted into slot 393, and left plug 710L is inserted into slot 394. The four plugs 710 function as covers for slots 391-394. Additionally, convex rectangular protrusion 810 on each plug 710 prevents the outer surface of outer wall 310 from being scratched when dropped or dragged over an abrasive surface. The raised protrusions 810 of plugs 710 support all of the weight of case 100 and the mobile device housed therein. These raised areas also help the user grip the plugs more securely when removing them from slots 391-394.

As noted above in FIG. 3, there are rectangular catches 330 in each of slots 391-394. Rectangular catches 330 are raised ridges in protective case 310 that engage a latch on an inserted plug or adaptor module. By way of example, plug 710 in FIG. 8B comprises tab 820 that inserts into one of slots 391-394. Tab 820 includes opening 830, which acts as a latch, and engages one of catches 330 when plug 710 is inserted into one of slot 391-394. This causes plug 710 to stay securely in place once inserted into a slot.

Figure 9A:
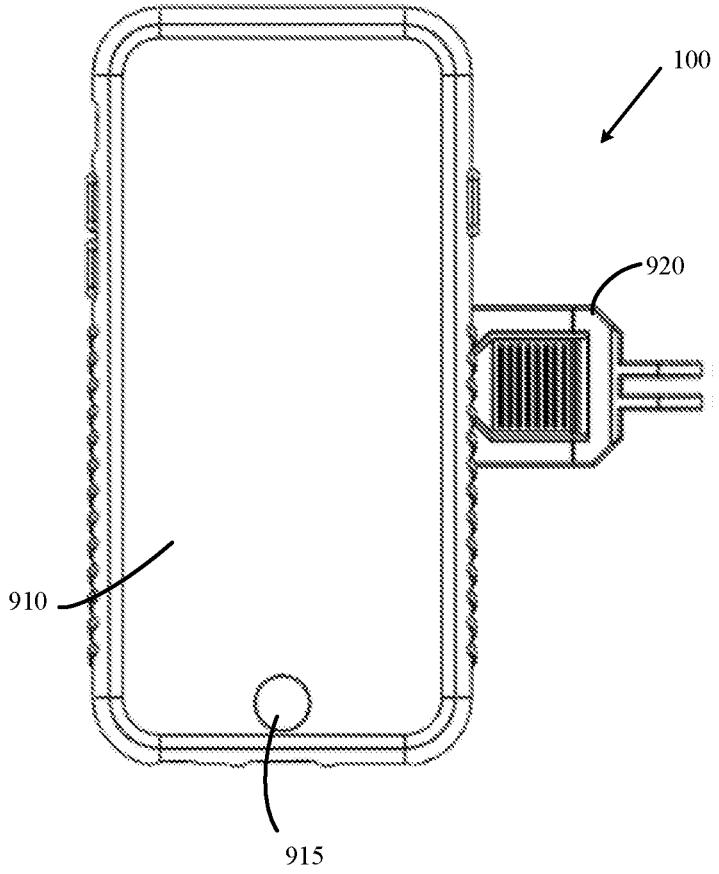
FIG. 9A illustrates an exemplary protective case containing a mobile phone and an exemplary adaptor module according to one embodiment of the disclosure.
Figure 9B:
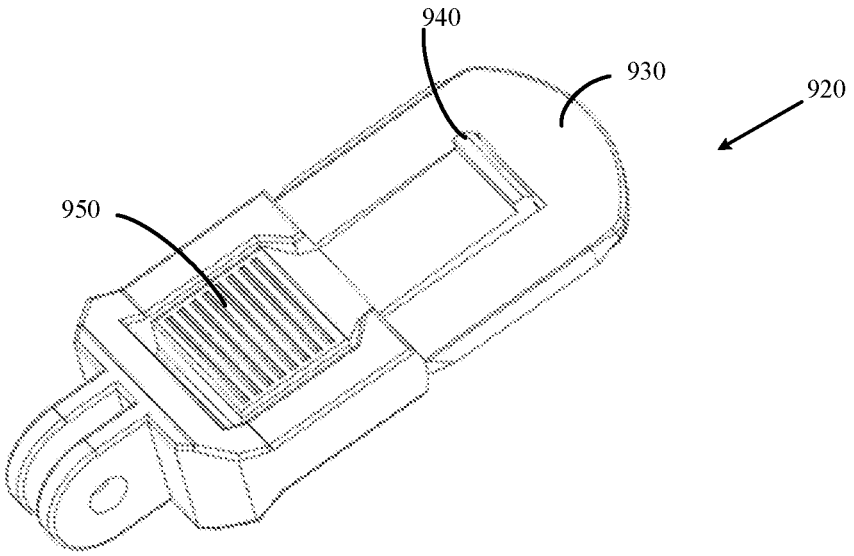
FIG. 9B is a detailed view of an exemplary adaptor module according to one embodiment of the disclosure.
Figure 10A:
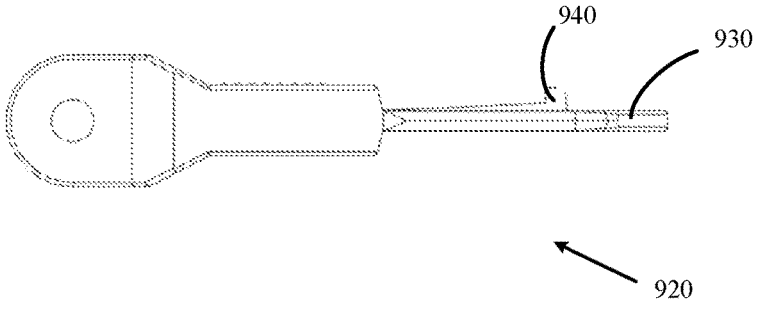
FIG. 10A is a side view of an exemplary adaptor module according to one embodiment of the disclosure.
Figure 10B:
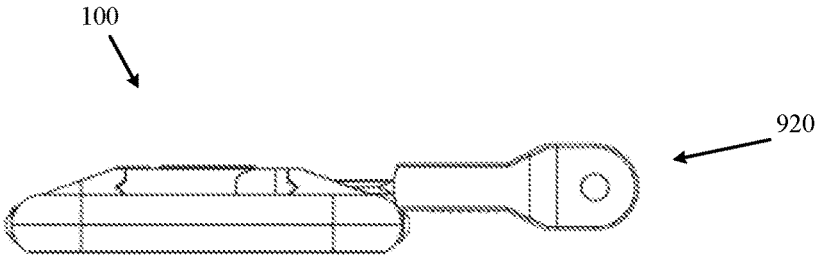
FIG. 10B is a side view of an exemplary adaptor module inserted into a protective case according to one embodiment of the disclosure.
Figure 10C:
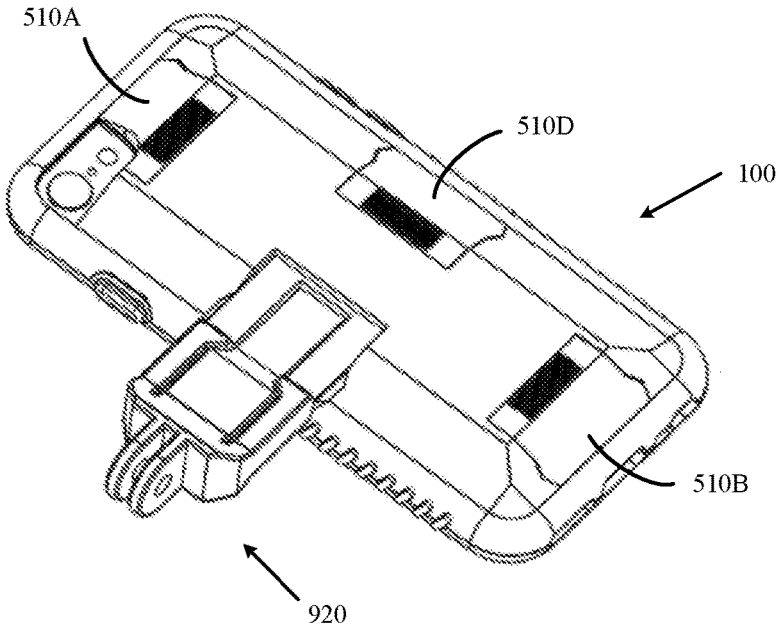
FIG. 10C is a rear perspective view of an exemplary adaptor module inserted into a protective case according to one embodiment of the disclosure.

FIG. 9A illustrates exemplary protective case 100 containing mobile phone 910 and exemplary adaptor module 920 according to one embodiment of the disclosure. Mobile phone 910 includes a "Home" button 915. FIG. 9B is a detailed view of exemplary adaptor module 920 according to one embodiment of the disclosure. FIG. 10A is a side view of exemplary adaptor module 920 according to one embodiment of the disclosure. FIG. 10B is a side view of exemplary adaptor module 920 inserted into protective case 100 according to one embodiment of the disclosure. FIG. 10C is a rear perspective view of exemplary adaptor module 920 inserted into protective case 100 according to one embodiment of the disclosure.

Adaptor module 920 comprises a tab 930 that fits into one of slots 391-394. Adaptor module 920 further comprises a locking latch 940 on one side (as in FIG. 10A), but not on the other side. The locking latch 940 comprises a bent lever spring that, as seen in FIG. 10A, projects upward from the surface slot 930. However, a user can depress the locking latch 940 by pressing down on the release button 950. This natural spring action enables the locking latch 940 to snag a catch 330 in one of slots 391-394. In a "locking position", the adapter module 920 is inserted in slot 391, for example, so that the locking latch 920 is faced towards, and engages with, the catch 330. This engagement creates a secure connection between the protective case 100 and the mount or attachment to which the adapter module 920 is fastened. The user removes the adaptor module 920 from the slot 391 by pressing the button 950 and pulling the adaptor module 920 out of the slot 391.

If the user does not want to lock the adapter module 920 in the slot 391, the user may flips over the adapter module 920 so that the locking latch 920 faces away from the catch 330 and then inserts the adapter module 920 into the slot 391. The user does not have to disengage the locking latch 920 to free the adapter module 920. The user simply pulls out the adapter module 920.

Figure 11A:
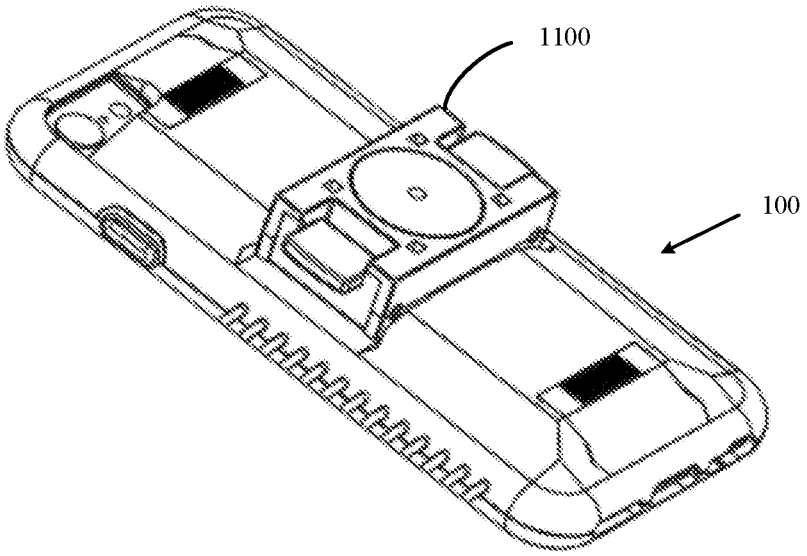
FIG. 11A is a perspective view of an exemplary protective case with an attached clip-on adaptor module according to one embodiment of the disclosure.
Figure 11B:
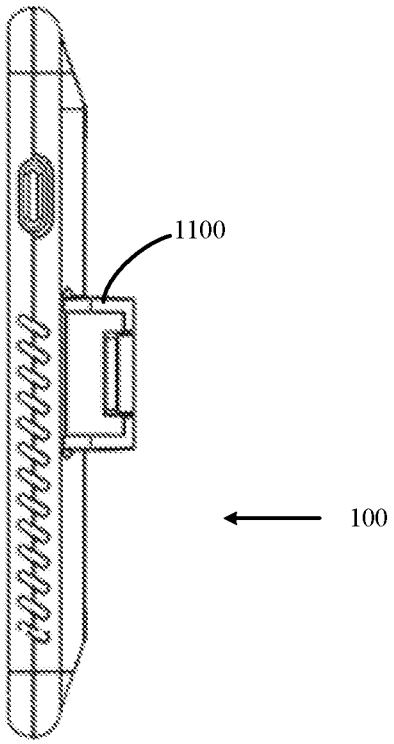
FIG. 11B is a side view of an exemplary protective case with an attached clip-on adaptor module according to one embodiment of the disclosure.
Figure 12:
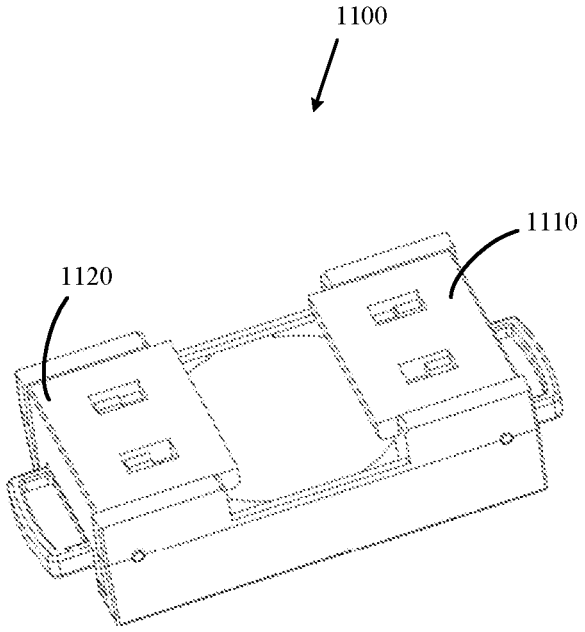
FIG. 12 is a perspective view of the reverse side of a clip-on adaptor module according to one embodiment of the disclosure.

FIG. 11A is a perspective view of an exemplary protective case 100 with an attached clip-on adaptor module 1100 according to one embodiment of the disclosure. FIG. 11B is a side view of an exemplary protective case 100 with an attached clip-on adaptor module 1100 according to one embodiment of the disclosure. FIG. 12 is a perspective view of the reverse side of a clip-on adaptor module 1100 according to one embodiment of the disclosure.

The clip-on adaptor module 1100 is a spring-loaded device that inserts into opposing slots, such as, for example, slots 393 and 394. The adaptor module 1100 may be used for many different purposes, depending on what is implemented in the adaptor module 1100. For example, the circular object in the adaptor module 1100 in FIG. 11A may be a magnet that is used to secure the protective case 100 to a metal surface or a peripheral device that may also have an embedded magnet. In FIG. 12, the clip-on adaptor module 1100 comprises spring mounted tabs 1110 and 1120, which insert into, for example, slots 393 and 394. The tabs 1110 and 1120 are pulled apart while clip-on adaptor module 1100 is positioned on the back of protective case 100 and then released. The springs (not shown) in the clip-on adaptor module 1100 then drive the tabs 1110 and 1120 towards each other, which causes the tabs 1110 and 1120 to become inserted into the slots 393 and 394.

Figure 13:
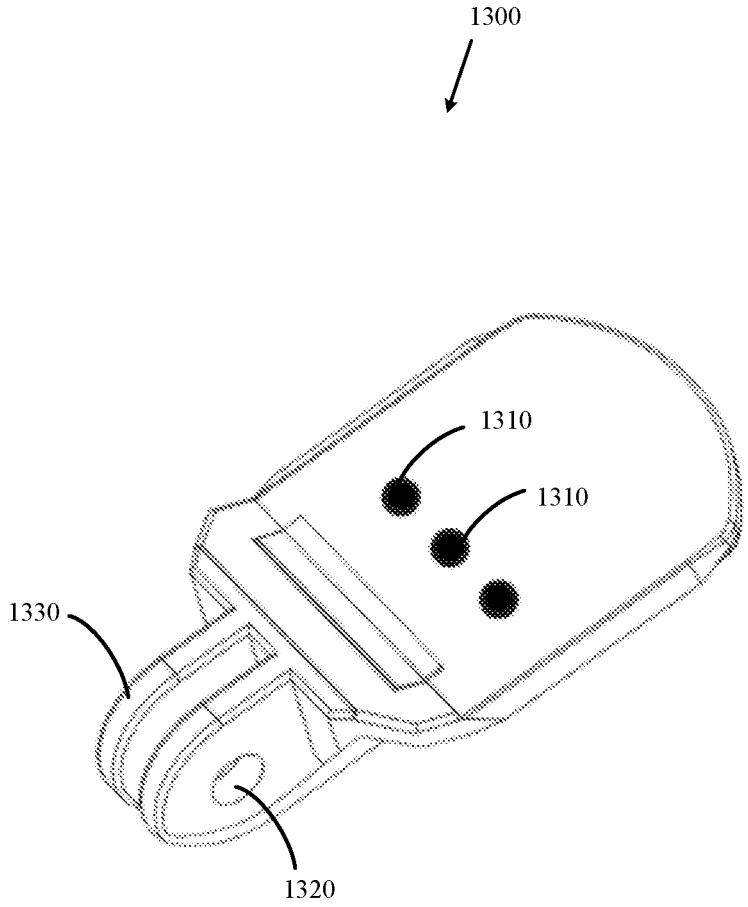
FIG. 13 illustrates an adaptor module that may be inserted into the protective case and secured by magnets according to one embodiment of the disclosure.

FIG. 13 illustrates an adaptor module 1300 that may be inserted into the protective case 100 and secured by magnets 1310 according to one embodiment of the present disclosure. As noted above, one or more of slots 391-394 may include one or more magnets 340. The magnets 1310, shown as black circles on the adaptor module 1300, connect with the magnets 340 in order to secure the adaptor module 1300 in place in one of slots 391-394. In an exemplary embodiment, the magnets 340 and the magnets 1310 may comprise neodymium magnets. These magnets allow mounting and attaching to the protective case 100 quickly and securely.

Figure 14:
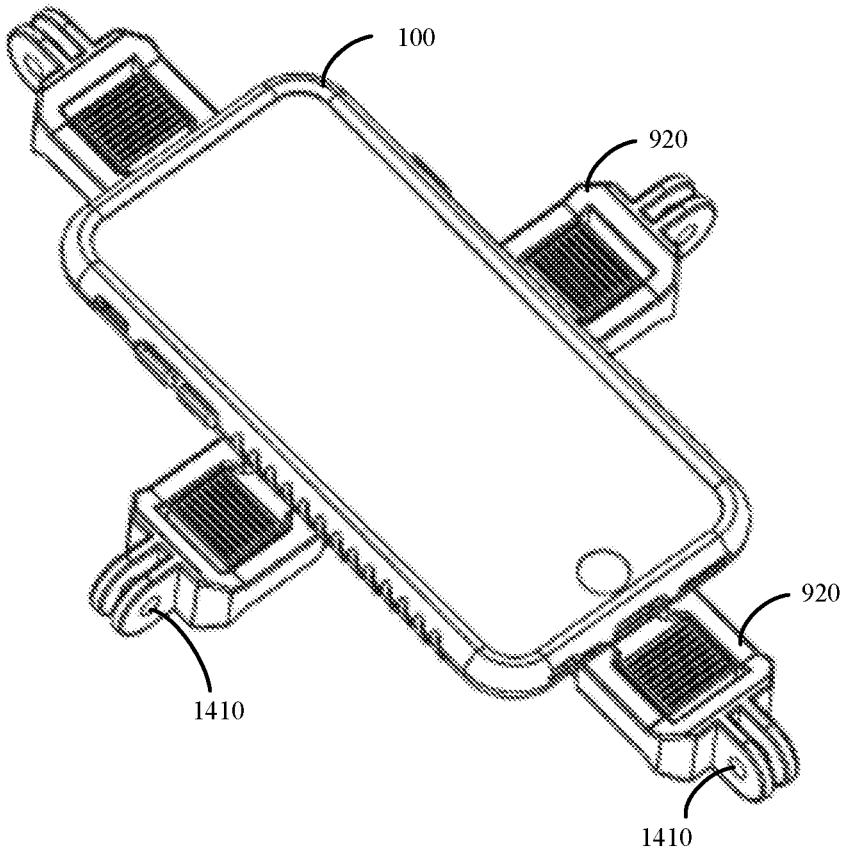
FIG. 14 illustrates a protective case 100 in which multiple adaptor modules are inserted according to one embodiment of the disclosure.

FIG. 14 illustrates a protective case 100 and a plurality of inserted adaptor modules 920 according to one embodiment of the present disclosure. In FIG. 14, four adaptor modules 920 are inserted in the four slots 391-394. In this configuration, the protective case 100 may be coupled to multiple peripheral devices via the holes 1410 in the flanges of the adaptor modules 920.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A protective case for an electronic device comprising a shell configured to receive the electronic device, the shell including:

a plurality of sidewalls that encircle a periphery of the electronic device;

an inner wall including an inner surface and an outer surface, the inner wall configured to support a rear surface of the electronic device; and an outer wall including an inner surface and an outer surface, wherein the inner surface of the outer wall and the outer surface of the inner wall are configured to form a compartment adjacent the outer surface of the inner wall.

2. The protective case as set forth in claim 1, wherein each of the plurality of sidewalls comprises a convex shape that curls around an edge of the electronic device.

3. The protective case as set forth in claim 1, wherein the inner surface of the inner wall comprises a grid of raised bumps that provide cushioning between the rear surface of the electronic device and the inner wall.

4. The protective case as set forth in claim 1, wherein the outer wall forms a plurality of slots, each of the plurality of slots configured to receive an adaptor module that is used to connect the protective case to a peripheral device or a support structure.

5. The protective case as set forth in claim 4, wherein a first of the plurality of slots comprises a securing mechanism configured to retain an adaptor module in the first slot.

6. The protective case as set forth in claim 5, wherein the securing mechanism comprises at least one magnet positioned in the first slot to align with a corresponding magnet on the adaptor module when the adaptor module is inserted in the first slot.

7. The protective case as set forth in claim 5, wherein the securing mechanism comprises a catch positioned in the first slot to align with a latching mechanism on the adaptor module when the adaptor module is inserted in the first slot.

8. The protective case as set forth in claim 4, wherein the outer wall comprises a flat central portion that is substantially parallel to the inner wall and a plurality of sloped surfaces surrounding the flat central portion.

9. The protective case as set forth in claim 8, wherein the compartment formed by the outer surface of the inner wall and the inner surface of the outer wall has a horizontal cross-section that is substantially trapezoidal.

10. The protective case as set forth in claim 9, wherein the compartment formed by the outer surface of the inner wall and the inner surface of the outer wall has a vertical cross-section that is substantially trapezoidal.

* * * * *